US008311470B2

(12) United States Patent
Okamoto

(10) Patent No.: US 8,311,470 B2
(45) Date of Patent: Nov. 13, 2012

(54) IMAGE HEATING APPARATUS HAVING AN INCLINABLE STEERING ROLLER CONFIGURED TO SUPPORT A BELT MEMBER CONTACTED BY A HEATING MEMBER CONFIGURED TO HEAT AN IMAGE ON RECORDING MATERIAL

(75) Inventor: Osamu Okamoto, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 192 days.

(21) Appl. No.: 12/844,008

(22) Filed: Jul. 27, 2010

(65) Prior Publication Data

US 2011/0026960 A1 Feb. 3, 2011

(30) Foreign Application Priority Data

Jul. 28, 2009 (JP) ..... 2009-175201

(51) Int. Cl.
*G03G 15/20* (2006.01)

(52) U.S. Cl. ..... 399/329

(58) Field of Classification Search ..... 399/329, 399/165, 162, 303, 313; 198/807, 810.03
See application file for complete search history.

(56) References Cited

U.S. PATENT DOCUMENTS 4,344,693 A * 8/1982 Hamaker ..... 399/165
4,367,031 A * 1/1983 Hamaker ..... 399/165
2008/0317524 A1* 12/2008 Takahashi et al. ..... 399/329
2009/0035034 A1* 2/2009 Nagase ..... 399/329
2009/0092425 A1* 4/2009 Hayashi ..... 399/329
2010/0296828 A1* 11/2010 Hara et al. ..... 399/69
2011/0008083 A1* 1/2011 Okamoto ..... 399/329
2011/0008084 A1* 1/2011 Okamoto ..... 399/329
2011/0008085 A1* 1/2011 Okamoto ..... 399/329

FOREIGN PATENT DOCUMENTS

JP 4-104180 4/1992
JP 2004-341346 12/2004

* cited by examiner

*Primary Examiner* — Sophia S Chen

(74) *Attorney, Agent, or Firm* — Fitzpatrick, Cella, Harper & Scinto

(57) ABSTRACT

An image heating apparatus includes: a belt member; an inclinable steering roller configured to support the belt member; a heating member configured to contact the belt member and heat an image on a recording material; a detecting member configured to detect a position of a belt end in a widthwise direction of the belt member; a correcting device configured to correct a position of the belt member in the widthwise direction by inclining the steering roller in accordance with a detected position of the belt end by the detecting member; and a supporting device configured to support the detecting member. The supporting device is provided with a contact portion for press-contacting an end surface of one end portion of a pressing roller configured to press the belt member against the heating member.

5 Claims, 5 Drawing Sheets

(a)

(b)

IMAGE HEATING APPARATUS HAVING AN INCLINABLE STEERING ROLLER CONFIGURED TO SUPPORT A BELT MEMBER CONTACTED BY A HEATING MEMBER CONFIGURED TO HEAT AN IMAGE ON RECORDING MATERIAL

FIELD OF THE INVENTION AND RELATED ART

The present invention relates to an image heating apparatus suitably usable for a fixing device of an image forming apparatus such as an electrophotographic copying machine or an electrophotographic printer and a belt feeding device suitably usable for such an image heating apparatus, for example.

As the fixing device for the image forming apparatus such as a copying machine and a printer of an electrophoto graphic type, a belt nipping type is known (a Japanese Laid-open Patent Application 2004-341346) which is provided with an endless heating belt, and, an endless pressing belt for contacting the belt to form a nip. A recording material carrying an unfixed toner image is nipped and fed by the nip, by which the toner image is heat-fixed on the recording material. In the fixing device of a belt nipping type, which uses an endless belt for the fixing belt or the pressing belt, the prevention of an offset (snaking movement) of the belt is an important technical problem. During the rotation of the belt, when the one longitudinal end portion and the other end portion of the roller offsets in the widthwise direction, there is a possibility that the belt disengages from a predetermined belt rotation range and an end of the belt is damaged. For the offset correction of the belt, a belt offset correcting control is used ordinarily, wherein an end position of one of the two rollers supporting the belt is changed, by which the belt produces the offsetting force to maintain the belt in the predetermined range (Japanese Laid-open Patent Application Hei 4-104180). In the fixing device which employs the belt offset correcting control, the temperature of the roller supporting the belt rises because the fixing member which forms the nip by contacting the roller or the belt is heated. Therefore, it is usual that in order to position the roller which does not carry out the offset correction in the longitudinal direction of the roller, one-end portion and the other end portion of the roller shaft are supported with respect to the longitudinal direction of the roller with a predetermined play to a roller supporting member, in consideration of the thermal expansion in the longitudinal direction of the roller. For this reason, at the time of a rotation of the belt, the roller is rotated in the state that it is urged to remove the play in one longitudinal end portion or the other end portion. However, when the urged side changes to the opposite side, the position of the belt end relative to the roller end is unstable, and there is a risk that the position of the belt member relative to the roller end cannot be accurately detected.

SUMMARY OF THE INVENTION

An object of the present invention is to provide an image heating apparatus, wherein the sensing accuracy of a position of a belt end relative to a roller end is enhanced.

According to an aspect of the present invention and there is provided an image heating apparatus comprising: a belt member; an inclinable steering roller for supporting the belt member; a heating member for contacting to the belt member and heating an image on a recording material; a detecting member for detecting a position of a belt end in a widthwise direction of the belt member; correcting means for correcting a position of the belt member in the widthwise direction by inclining the steering roller in accordance with a detected position of the belt end by the detecting member; supporting means for supporting the detecting member; and the supporting means being provided with a contact portion for press-contacting the end surface of one end portion of a pressing roller configured to press the belt member against the heating member.

These and other objects, features, and advantages of the present invention will become more apparent upon consideration of the following description of the preferred embodiments of the present invention, taken in conjunction with the accompanying drawings.

Figure 3:
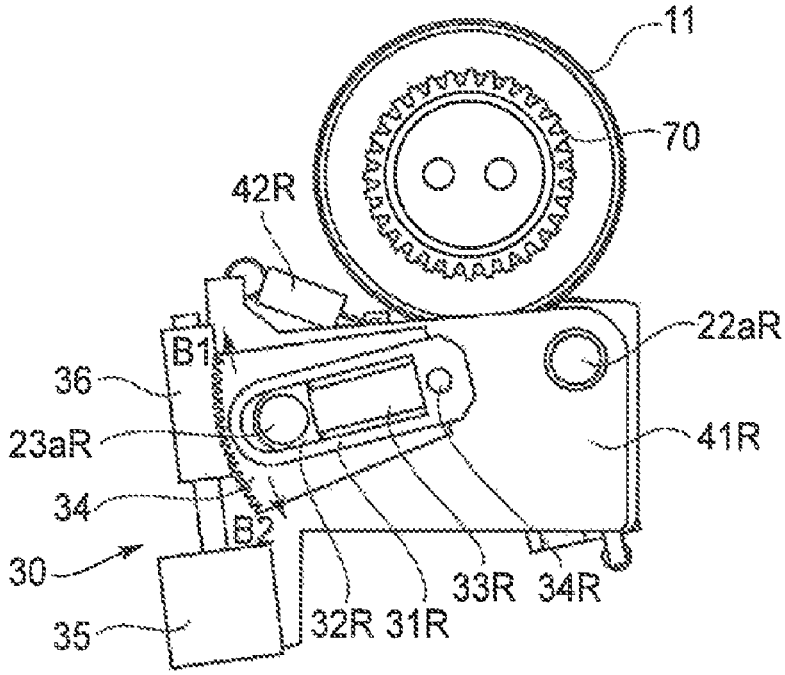
Figure 3:
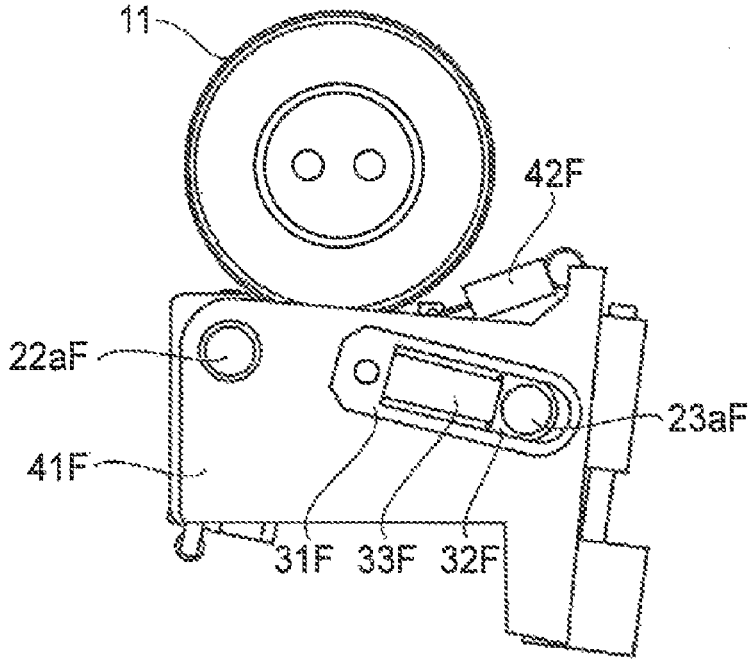

Part (a) of FIG. 3 is a side view of the fixing device of Embodiment 1, as seen from the other side in a longitudinal direction thereof, and (b) is a side view of the fixing device of Embodiment 1, as seen from the one side in a longitudinal direction thereof.

Figure 4:
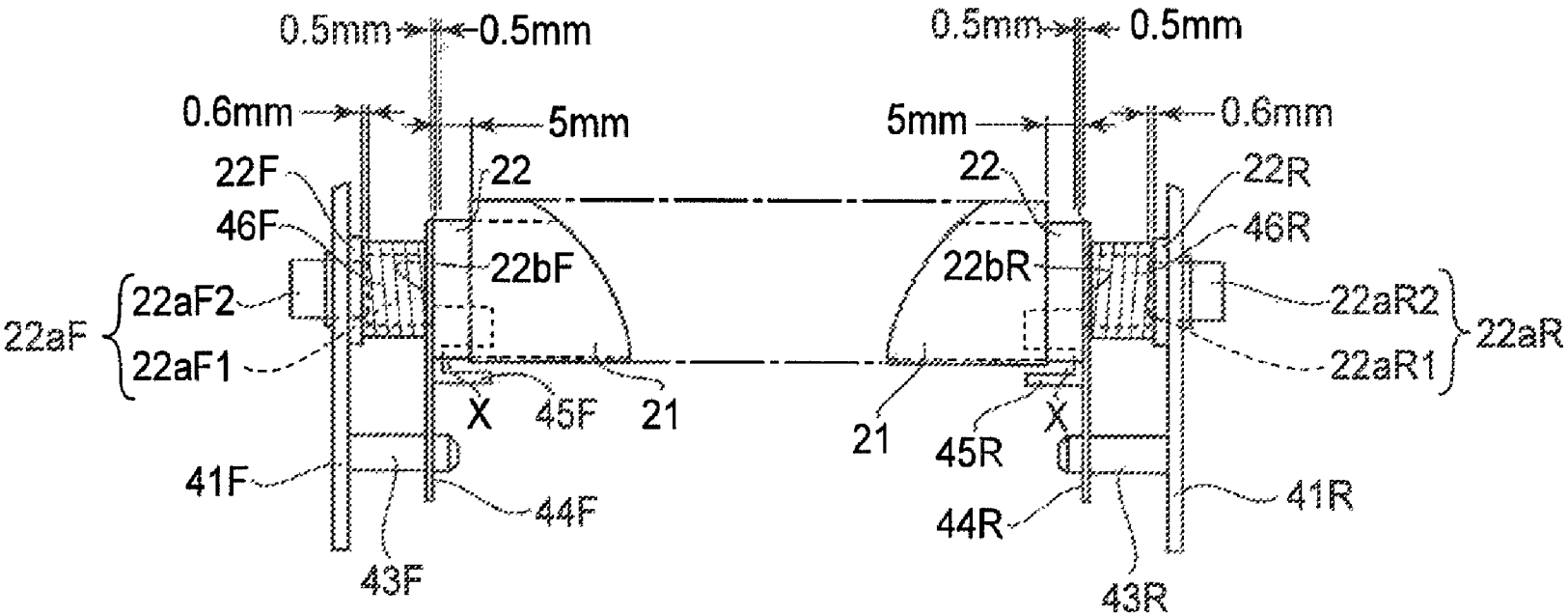

FIG. 4 is a schematic view, as seen from a sheet discharging side of a pressing unit, of the fixing device according to Embodiment 1, and it is an illustration of a positioning structure and a play-removing-urging regulating structure for a pressing roller.

Figure 5:
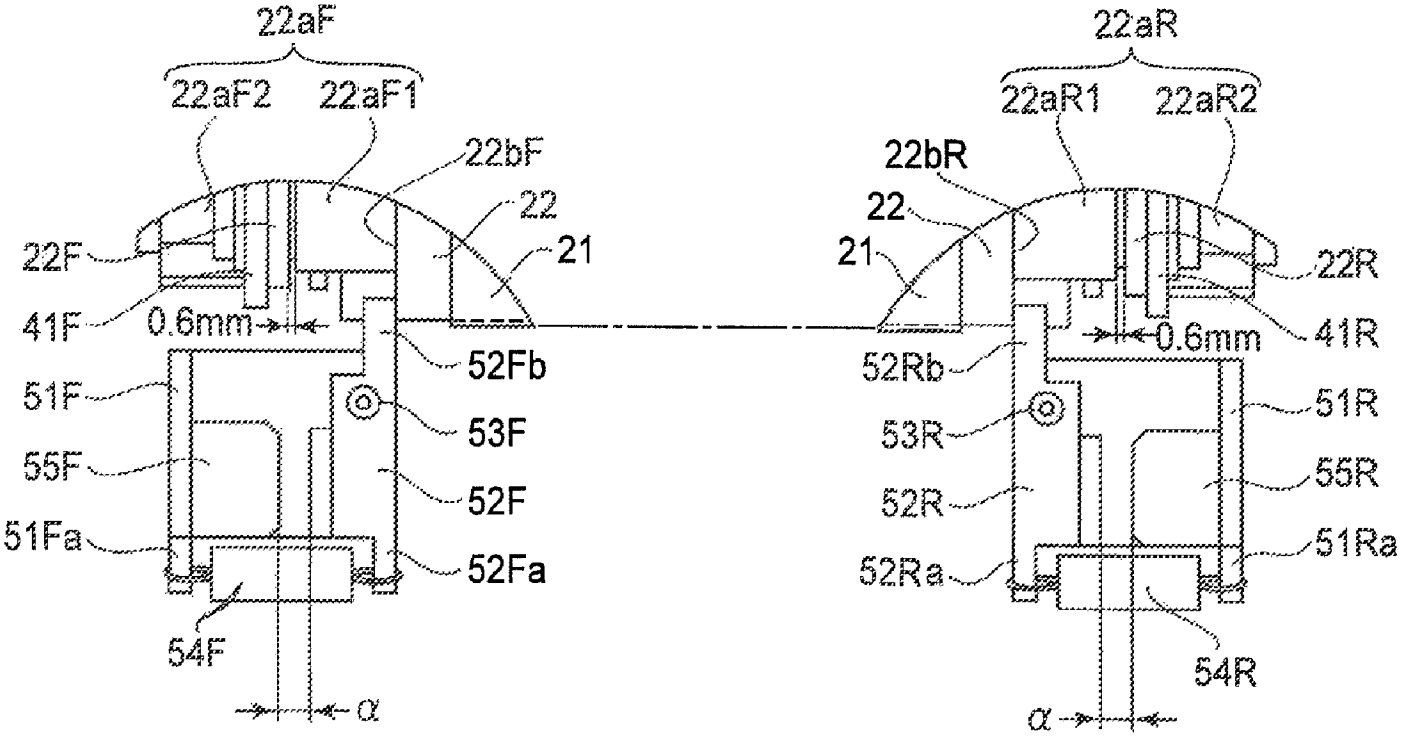

FIG. 5 is a schematic view, as seen from the sheet discharging side, of the pressing unit of the fixing device according to Embodiment 2, and it is an illustration of the play-removing-urging regulating structure for the pressing roller.

Figure 6:
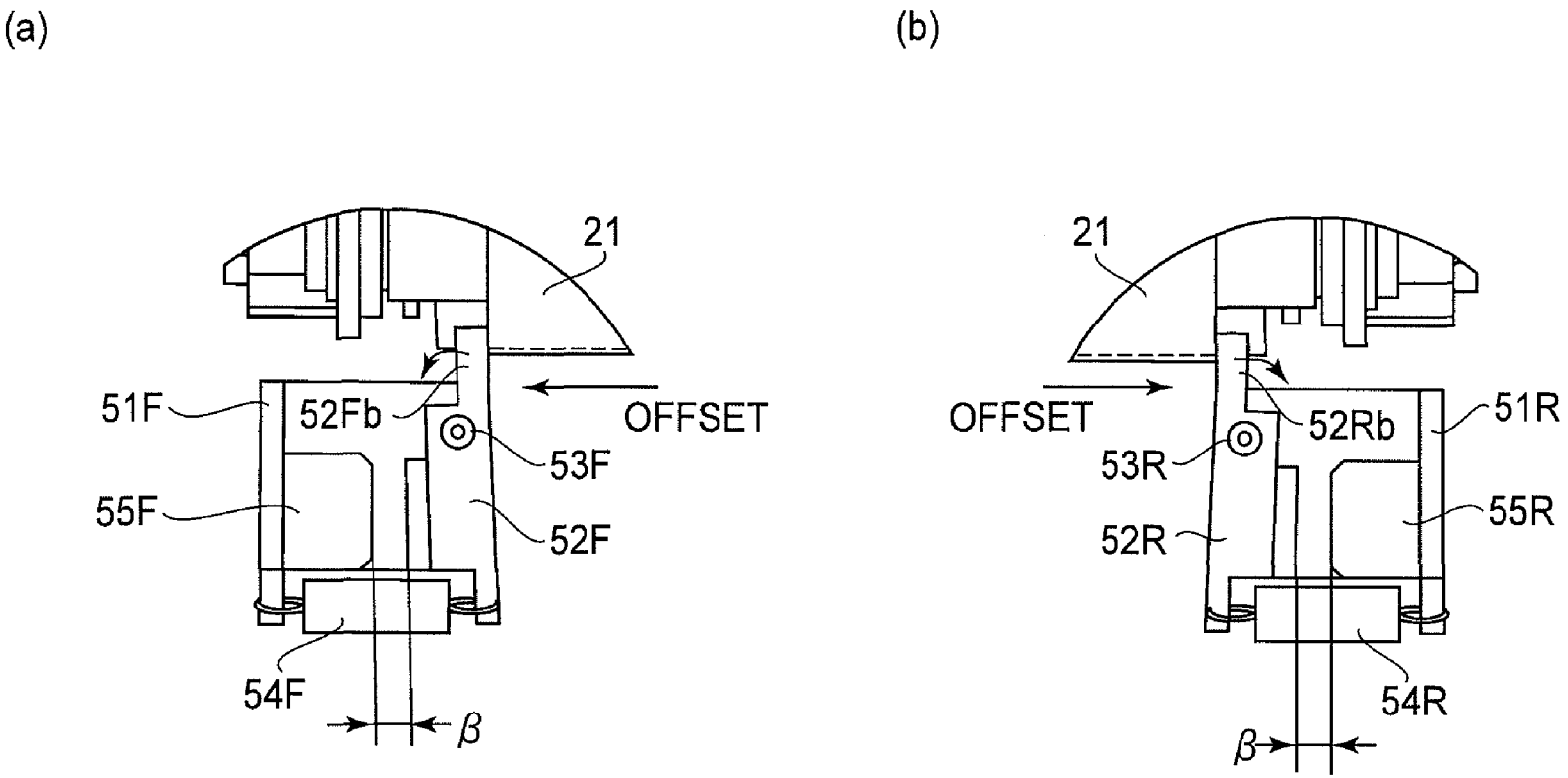

Part (a) of FIG. 6 is an illustration of a displacement state of a pressing arm of the play-removing-urging regulating structure for the one longitudinal end portion side of the pressing roller in the pressing unit of the fixing device of Embodiment 2, (b) is an illustration of the displacement state of the pressing arm of the play-removing-urging regulating structure for the other longitudinal end portion side of the pressing roller.

DESCRIPTION OF THE PREFERRED EMBODIMENT

Embodiment 1

Figure 1:
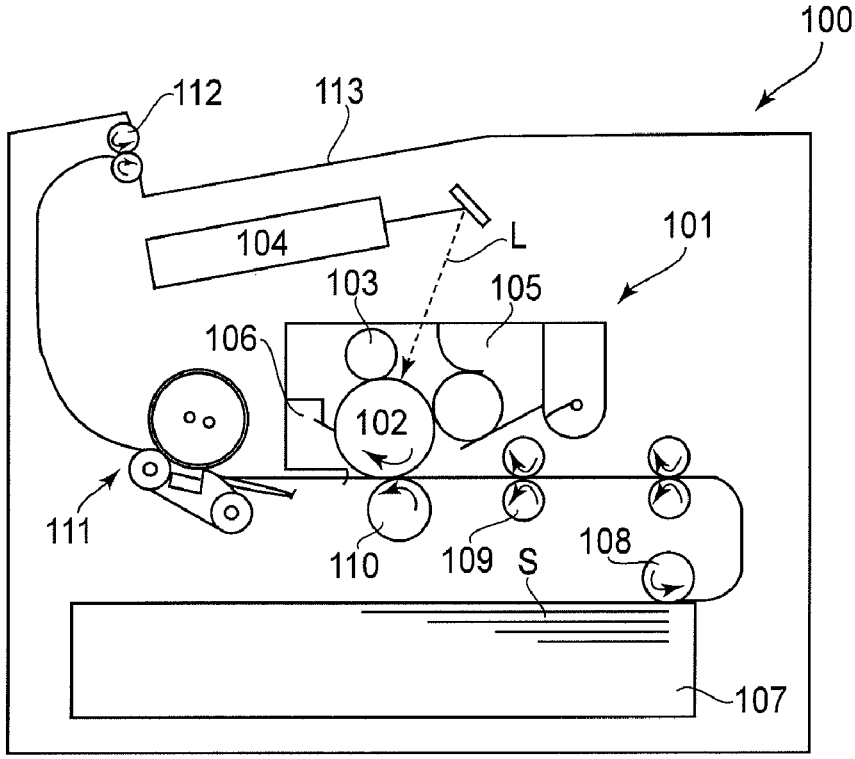
FIG. 1 is a schematic view of a general arrangement of an example of an image forming apparatus.

(1) Image Forming Apparatus:

FIG. 1 is a schematic view of the general arrangement of an example of the image forming apparatus which employs an image heating apparatus according to the present invention as the fixing device (fixing device). The image forming apparatus is a laser beam printer of an electrophotographic type. An image forming apparatus 100 according to this Embodiment 1 can be divided into an image forming station 101 for forming a toner image on a sheet S functioning as a recording material, and a fixing device 111 for fixing the toner image by a heated member pressing on the sheet S (image heating apparatus). The image forming station 101 is provided with devices described below. A charger 103 functioning as charging means is provided to the circumference of an outer surface (surface) an electrophotographic photosensitive member (photosensitive drum) 102 of a drum configuration functioning as an image bearing member. The surface of a photosensitive drum 102 is uniformly charged by the charger 103. A laser beam L corresponding to an image is projected on the charged surface of the surface of the photosensitive drum 102 from an exposure device 104 functioning as exposure means, by which an electrostatic latent image is formed on the charged surface. The electrostatic latent image is developed with the toner by a developing device 105 functioning as developing means. By this, the toner image is formed on the surface of the photosensitive drum 102. On the other hand, the sheets S stacked on a feeding cassette 107 below the image forming apparatus 100 are fed one by one by a feeding roller 108 and reach a registration roller pair 109 functioning as feeding means. Each sheet S is fed to a transfer nip portion between the photosensitive drum 102, and a transfer roller 110 functioning as transferring means, by the registration roller pair 109 in synchronism with the toner image on the surface of the photosensitive drum 102. The sheet is nipped and fed between the photosensitive drum 102 surface and the outer surface of the transfer roller 110 (surface) in the transfer nip portion. In the feeding process, the toner image on the surface of the photosensitive drum 102 is transferred electrostatically onto the sheet S by the transfer roller 110. By this, the sheet S carries an unfixed toner image on the surface of the sheet S. The sheet S carrying the toner image is fed to a fixing device 111. The toner image is heat-fixed on the sheet S in the fixing device 111 by imparting heat and the pressure to the unfixed toner image. The sheet S that has been heat-fixed is fed to a discharging roller pair 112 by the fixing device 111. The sheet is discharged to a discharging tray 113 in an upper portion of the image forming apparatus 100 by the discharging roller pair 112. Untransferred toner which remains on the photosensitive drum 102 surface after the transferring of the toner image is removed by a cleaning device 106, which functions as a cleaning means.

Figure 2:
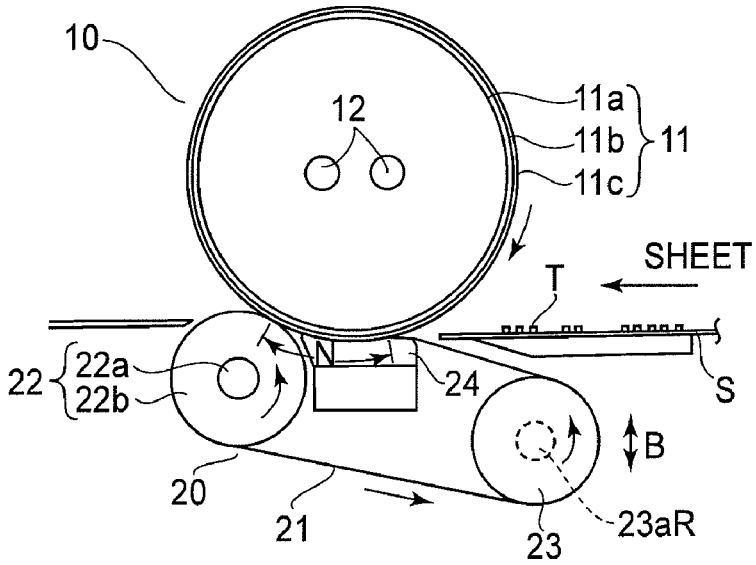
FIG. 2 is a cross-sectional view of a general arrangement of a fixing device according to Embodiment 1.

(2) Fixing Device:

In the following descriptions, relating to the fixing device, and a member which constitutes at least a part of the fixing device, a longitudinal direction is the direction perpendicular to a sheet feeding direction (recording material feeding direction) in the plane of the sheet. A widthwise direction is the direction parallel with the sheet feeding direction (recording material feeding direction) in the surface of the sheet. The length is a dimension in the longitudinal direction. The width is the dimension in the widthwise direction. FIG. 2 is a cross-sectional view of the general arrangement of the fixing device according to this Embodiment 1. The fixing device according to this Embodiment 1 is the fixing device of a belt nipping type, which is provided with a belt feeding device, wherein a fixing roller contacts a belt member to form a nip therebetween. The fixing device 111 is provided with a fixing unit 10, and a pressing unit 20. The fixing unit 10 is provided with the fixing roller 11 functioning as a heating member. For example, the fixing roller 11 is provided with a metal core 11*a* comprising an aluminum cylindrical tube of an outer diameter of 56 mm and an inner diameter of 50 mm. One longitudinal end portion of the metal core 11*a* and the other longitudinal end portion thereof are rotatably supported by a side plate (unshown) of the fixing unit 10. The surface of the metal core 11*a* is coated with an elastic layer 11*b* of a silicone rubber which has the thickness of 2 mm and a hardness (Asker C) of 45 degree, for example, and the elastic layer 11*b* is further coated with a PF57 or PTFE heat resistive parting layer 11*c* functioning as a surface layer. A halogen heater 12 functioning as a heating source is provided in the metal core 11*a* of the fixing roller 11. In this halogen heater 12 mouthpieces in the one longitudinal end portion of the halogen heater 12 and the other longitudinal end portion are supported by the side plate (unshown) of the fixing unit 10. The pressing unit 20 is provided with an endless pressing belt 21, functioning as a belt member. The pressing belt 21 is circulatably trained around a pressing roller 22 functioning as the rotatable member for the positioning, and a steering roller 23 with a predetermined tension (100 Ns, for example). The pressing roller 22 is made of a solid stainless steel, for example having an outer diameter of 20 mm. The steering roller 23 has a belt steering function and a function of applying a belt tension, and it is made of hollow stainless steel having an outer diameter of 20 mm, and an inner diameter of approx. 18 mm, for example. The steering roller 23 functions, as a steering member for adjusting the offsetting (snaking movement), in the longitudinal direction, of a pressing belt 21 and functions also as a belt stretching member for adjusting the tension of the pressing belt 21. In the pressing unit 20, the pressing belt 21 is provided, so that the outer surface (surface) of the pressing belt 21 opposes to the outer surface (surface) of the fixing roller 11 below the fixing roller 11. It is trained around the pressing roller 22 and the steering roller 23 so as to incline angularly downwardly relative to the fixing roller 11. The pressing roller 22 opposes the fixing roller 11 with the pressing belt 21 therebetween. The pressing springs 42F, 42R as will be described hereinafter, urge the pressing roller 22 toward the fixing roller 11 to contact a pressing belt 21 surface and a fixing roller 11 surface to each other. The urging forces of the pressing springs 42F, 42R are applied on the elastic layer 11*b* of the fixing roller 11 through the pressing belt 21 to elastically deform the elastic layer 11*b* by the predetermined amount, by which a part of a fixing nip is formed. The inside of the pressing belt 21 is provided with a pressing pad 24 made of the silicone rubber (pressing member), for example, which is extended along the longitudinal direction of the pressing belt 21. A pressing pad 24 is pressed to an inner surface (inner surface) of the pressing belt 21 a pressing spring (unshown) with a predetermined pressure, for example 400 Ns and by pressing the pressing pad 24 against the inner surface of the pressing belt 21, a contact area between the fixing roller 11 surface and the pressing belt 21 surface is increased with respect to the sheet feeding direction. By this, correspondingly to the contact area, a wide fixing nip N can be formed by the fixing roller 11 surface and the pressing belt 21 surface. By this, the nipping feeding time in which the sheet S carrying the unfixed toner image T is within the fixing nip N can be lengthened, so that the glossiness of the toner image T is increased, and the image formation speed is increased.

In the fixing device 111 according to this Embodiment 1, when a driving input gear 70 (part (a) of FIG. 3) provided on an end surface of one longitudinal end portion of the fixing roller 11 is rotated by a fixing motor (unshown), the fixing roller 11 is rotated in the direction indicated by an arrow (FIG. 2). A rotational force of this fixing roller 11 is transmitted to the pressing belt 21 through the fixing nip N to rotate the pressing belt 21 in the direction of the arrow. Electric power is applied from a power supplying circuit (unshown) to the halogen heater 12 to light up the halogen heater 12 to heat the fixing roller 11. A temperature of the fixing roller 11 surface is detected by a temperature detecting member (unshown) such as a thermistor provided adjacent to a fixing roller 11 surface. A controller (unshown) comprising a CPU and a memory such as RAM and ROM receives an output signal of the temperature detecting member to control the feeder circuit based on the output signal, so that a surface temperature of the fixing roller 11 is maintained at a predetermined fixing temperature (target temperature). In the present Embodiment 1, the fixing temperature on the surface of the fixing roller 11 is maintained at approx. 190 degree C. In the state that the fixing roller 11 surface is maintained at the predetermined fixing temperature, the sheet S carrying the unfixed toner image T is introduced into the fixing nip N of the fixing device 111 with a toner image carrying surface facing up. The sheet S is nipped and fed by the fixing roller 11 surface and the pressing belt 21 surface in the fixing nip N. In the feeding process, by applying the heat of the fixing roller 11 and the pressure of the fixing nip N to the toner image T, the toner image T is heat-fixed on the sheet S surface.

(3) Pressing Belt Offset Controlling Mechanism:

Part (a) of FIG. 3 is a side view of the fixing device according to this Embodiment 1, as seen from the other side in the longitudinal direction. Part (b) is a side view of the fixing device according to this Embodiment 1, as seen from the one side in the longitudinal direction. The pressing belt offset controlling mechanism (correcting means) 30 will be described. In the pressing belt offset controlling mechanism 30, a metal core 22*a*R of the pressing roller 22 and a metal core 23*a*R of the steering roller 23 are supported by the steering roller supporting arm 31R adjacent to the side plate (41R) of the pressing unit 20. Of the metal core 22*a*R of the pressing roller 22 and the metal core 23 aR of the steering roller 23, the metal core 23*a*R of a pressing steering roller 23 is movable in the direction perpendicular to the longitudinal direction of the pressing belt 21 more particularly in an up-down direction shown in arrow B (FIG. 2). A metal core 22*a*F of the one longitudinal end portion of the pressing roller 22 is rotatably supported by the side plate 41F in one longitudinal end portion of the fixing device 111 (Part (b) of FIG. 3). The metal core 22*a*R of the other longitudinal end portion of the pressing roller 22 is rotatably supported by the side plate 41R in the other longitudinal end portion of the fixing device 111 (Part (a) of FIG. 3). A metal core 23*a*F provided in the one longitudinal end portion side of the pressing steering roller 23 is rotatably supported in the one longitudinal end portion of the fixing device 111 by the side plate 41F and a steering roller supporting arm 31F (Part (b) of FIG. 3). The metal core 23*a*R provided in the other longitudinal end portion side of the pressing steering roller is rotatably supported in the other longitudinal end portion of the fixing device 111 by the side plate 41R and a steering roller supporting arm 31R (Part (a) of FIG. 3). The side plate (41R) steering roller supporting arm 31R supports a bearing 32R slidably in a direction of the belt tension (Part (a) of FIG. 3). The bearing 32R is provided in a side plate 41R, and rotatably supports the metal core 23*a*R of the pressing steering roller 23, so that it is movable in the up-down direction shown by the arrow B. The steering roller supporting arm 31R holds a tension spring 33R for urging the bearing 32R in the direction of the belt tension to apply a constant tension thereto. The steering roller supporting arm 31R is provided on an outer surface of the side plate 41R, and a widthwise end portion opposite from the end which supports the bearing 32R is rotatably supported on the side plate 41R by an arm supporting shaft 34R. To an outer periphery of the steering roller supporting arm 31R, a sector gear 34 is fixed. The sector gear 34 engages a worm gear 36 provided on an output shaft of a belt offset control motor 35 supported by the side plate 41R. The steering roller supporting arm 31F in the side plate (41F) supports a bearing 32F (Part (b) of FIG. 3) slidably in the direction of the belt tension. The bearing 32F is provided in a side plate 41F, and rotatably supports the metal core 23*a*F of the pressing steering roller 23, so that it cannot move in the up-down direction shown by the arrow B. The steering roller supporting arm 31F holds a tension spring 33F for urging the bearing 32F in the direction of the belt tension to apply the predetermined tension to it. The steering roller supporting arm 31F is fixed on the outer surface of the side plate 41F. Therefore, of the steering roller supporting arms 31F, 31R, the steering roller supporting arm 31R is swingable about the arm supporting shaft 34R in the up-down direction shown in arrow B (FIG. 2). For this reason, the pressing steering roller 23 can make a predetermined amount of the steering movement about the metal core 23*a*F supported by the steering roller supporting arm 31F, in the steering roller supporting arm (31R) side in the up-down direction shown by the arrows B1 and B2 (Part (a) of FIG. 3). In other words, the pressing steering roller 23 is inclinable in accordance with a swinging of the steering roller supporting arm 31R about the metal core 23*a*F, so that the metal core (23*a*R) side moves to the up-down direction shown by the arrows B1 and B2 perpendicular to the sheet feeding direction through the predetermined amount.

The side plate 41F of the pressing belt offset controlling mechanism 30 and the side plate of the fixing unit 10 corresponding to the side plate 41F are connected with each other by the pressing spring 42F (part (b) of FIG. 3). The side plate 41R of the pressing belt offset controlling mechanism 30 and the side plate of the fixing unit 10 corresponding to the side plate 41R are connected with each other by a pressing spring 42R (part (a) of FIG. 3). As has been described in the foregoing, by the pressing springs 42F, 42R, the pressing roller 22 is urged and approaches the surface of the fixing roller 12, by which the pressing belt 21 surface and the fixing roller 11 surface contact to each other to form a part of fixing nip N.

(4) Belt Offset Correcting Control for Pressing Belt Offset Controlling Mechanism:

Referring to FIG. 3, the belt offset correcting control of the pressing belt offset controlling mechanism 30 executed by the controller will be described. In part (a) of FIG. 3, the pressing belt 21 offsets toward the side plate (41F) side, for example until the end position at one longitudinal end portion side of the pressing belt 21 is detected by the sensor (detection member, FIG. 4) 45F as will be described hereinafter, and at this time the controller captures the output signal from a sensor 45F. The output shaft of the belt offset control motor 35 is rotationally driven in a CW direction to move the sector gear 34 through the predetermined amount in the downward direction shown by an arrow B2 (part (a) of FIG. 3). The worm gear 36 rotates in accordance with a rotation of the output shaft of the belt offset control motor 35, by which the steering roller supporting arm 31R moves in the direction of the arrow B2 with the sector gear 34. In interrelation with a movement, with respect to the a direction of the arrow B2, of the steering roller supporting arm 31R, a metal core (23*a*F) side of the pressing steering roller 23 inclines in the direction of the arrow B2. With an inclination, in the direction of the arrow B2, of the pressing steering roller 23, the pressing belt 21 starts the offset movement toward the side plate (41R). When the pressing belt 21 offsets toward the side plate (41R), so that the other longitudinal end portion of the pressing belt 21 is detected by the sensor (detection member, FIG. 4) 45R as will be described hereinafter, the controller captures the output signal from a sensor 45R. The output shaft of the belt offset control motor 35 is rotationally driven in a CCW direction to move the sector gear 34 in the upward direction shown by the arrow B1 (part (a) of FIG. 3) by the predetermined amount. The worm gear 36 rotates, in accordance with the rotation of the output shaft of the belt offset control motor 35, by which the steering roller supporting arm 31R moves in a direction of the arrow B1 with the sector gear 34. In interrelation with the movement, in the direction of the arrow B1, of the steering roller supporting arm 31R, the metal core (23*a*R) side inclines the pressing steering roller 23 in the direction of the arrow B1. It follows on the inclination, in the direction of the arrow B1, of the pressing steering roller 23, the pressing belt 21 starts the offset movement to the side plate (41F) side. The pressing belt 21 offsets and moves toward the side plate (41F), and the one longitudinal end portion position of the pressing belt 21 is again detected by the sensor 45F. Then, by the rotation, in the direction of the output shaft CW, of the belt offset control motor 35, the pressing steering roller 23 is again inclined in the direction of the arrow B2. The pressing belt 21 offsets and moves toward the side plate (41R), and the other longitudinal end portion position of the pressing belt 21 is again detected by the sensor 45R. Then, by the rotation, in the direction CCW of the output shaft, of the belt offset control motor 35, the pressing steering roller 23 is again inclined in the direction of the arrow B1. By repeatedly carrying out the above-described process, so that the belt does not protrude from the end surface of the one longitudinal end portion of the pressing steering roller 23, and the other longitudinal end portion, the belt offset correcting control for correcting a position of the pressing belt 21 in the longitudinal direction is carried out.

(5) Positioning Structure and Play-Removing-Urging Regulating Structure of Pressing Roller:

FIG. 4 is the schematic view, as seen from the sheet discharging side, of the pressing unit of the fixing device according to this Embodiment 1, and it is an illustration of positioning structure for the pressing roller and the play-removing-urging regulating structure. First, the positioning structure for the pressing roller 22 will be described. The metal core 22*a*R in the other longitudinal end portion of the pressing roller 22 is rotatably supported through a bearing 22R by the side plate 41R, and the metal core 22*a*F in one longitudinal end portion of the pressing roller 22 is rotatably supported through a bearing 22F by the side plate 41F. The temperature of the pressing roller 22 rises up to about 150 degrees C. by the fixing roller 11 being heated. For this reason, as for the positioning, with respect to the longitudinal direction, of the pressing roller 22, the metal cores 22*a*F, 22*a*R are supported by the side plates 41F, 41R, so that a play of 0.6 mm is provided between the side plates 41F, 41R and the metal cores 22*a*F, 22*a*R, in consideration of the thermal expansion, with respect to the longitudinal direction, of the pressing roller 22. More particularly, the metal core 22*a*F is provided with large diameter portions 22*a*F1, 22*a*R1 and small diameter portions 22*a*F2, 22*a*R2, and the small diameter portion 22*a*F2 is supported by the bearing 22F, so that a gap of 0.6 mm is provided between the large diameter portion 22*a*F1 and the bearing 22F. Similarly, the metal core 22*a*R is provided with a large diameter portion 22*a*R1 and a small diameter portion 22*a*R2, and the small diameter portion 22*a*R2 is supported by the bearing 22R, so that the play of 0.6 mm is provided between the large diameter portion 22*a*R1 and the bearing 22R. By this, at the time of a rotation of the pressing belt 21, the pressing roller 22 is rotated in the state that there is no play in one side of the metal cores 22*a*F, 22*a*R. During the rotation of the pressing roller for example, when the play-removing urging of the pressing roller is carried out on the metal core (22*a*F) side, until the large diameter portion 22*a*F1 of the metal core 22*a*F contacts to the bearing 22F, the metal core (22*a*F) side edge 22*b*F of the pressing roller deviates from the position shown in FIG. 4 by 0.6 mm toward the bearing (42F). On the contrary, with this, during the rotation of the pressing roller, when the pressing roller is moved to remove the play with respect to the metal core (22*a*R), until the large diameter portion 22*a*R1 of the metal core 22*a*R contacts the bearing 22R, a side edge 22*b*R of the metal core (22*a*R) of the pressing roller deviates from the position shown in FIG. 4 by 0.6 mm toward the bearing (42R). As for a roller length of the pressing roller 22 between the roller end surfaces 22*b*F, 22*b*R, a manufacturing error of ±0.5 mm arises. Therefore, in order to make the pressing belt 21 reciprocate, without protruding from the roller end surfaces 22*b*F, 22*b*R in the longitudinal direction of the pressing roller 22, an end detection position X, with respect to the longitudinal direction, of the pressing belt 21 by sensors (detection members) 45R and 45F is as follows. The belt end detection position X satisfies following from the roller end surfaces 22*b*F, 22*b*R of a pressing roller 21.

$$X>0.6+0.5=1.1 \text{ (mm)}$$

In other words, with respect to the roller length of the roller portion of the pressing roller 22, the pressing belt 22 reciprocates in the range which is the inside by 1.1 mm from the roller end surfaces 22*b*F, 22*b*R of the pressing roller 22 at the respective sides. Distances to the roller end surfaces 22*b*F, 22*b*R from the belt end are approx. 5 mm in the state that the pressing belt 21 is maintained in the predetermined position in the longitudinal direction of the pressing steering roller 23, that is, at the time of a longitudinally central portion of the pressing belt 21 being placed in the longitudinally central portion of the pressing roller 22.

A play-removing-urging regulating structure for the pressing roller 22 will be described. The inner surface of the side plate 41F is provided with a supporting shaft 43F which projects toward the side plate (41R) along an axial direction of the pressing roller 22. The supporting shaft 43F supports a sensor base (supporting member) 44F displaceably in the longitudinal direction of the pressing roller 22. A sensor base 44F contacts a roller end surface 22*a*F of the pressing roller 22 at the side plate 41F side. The inner surface of the sensor base 44F is provided with the sensor 45F for detecting the one longitudinal end portion position of the pressing belt 21. Between a sensor base 44F and bearing 22F, a coil spring (urging member) 46F is compressed. The coil spring 46F urges the sensor base 44F to the roller end surface 22*b*F of the pressing roller 22, by which a large diameter portion 22*a*F of the metal core 22*a*F of the pressing roller 22 is spaced by an amount of the play from the bearing 22F. Similarly, the inner surface of the side plate 41R is provided with a supporting shaft 43R which projects toward the side plate (41F) along the axial direction which is the pressing roller 22. The supporting shaft 43R supports the sensor base (supporting member) 44R displaceably in the longitudinal direction of the pressing roller 22. A sensor base 44R contacts a roller end surface 22*a*R of the pressing roller 22 of the side plate 41R. The inner surface of the sensor base 44R is provided with the sensor 45R for detecting the other longitudinal end portion widthwise end position disposition of the pressing belt 21. Between a sensor base 44R and the bearing 22R, the coil spring (urging member) 46R is compressed. The coil spring 46R urges the sensor base 44R to a roller end surface 22*b*R of the pressing roller 22, by which the large diameter portion 22*a*R1 of the metal core 22*a*R of the pressing roller 22 is spaced by the amount of the play from the bearing 22R. By this, the roller end surfaces 22*a*F, 22*a*R of the pressing roller 22 rotate to the state of contacting sensor bases 44F, 44R, and therefore, the pressing roller 22 is not moved to remove the play to the metal core (22*a*F) side or the metal core (22*a*R) side. More particularly, the play-removing urging of the pressing roller 22 can be regulated. For this reason, irrespective of the play of the pressing roller and the error in the manufacturing of the roller length of the pressing roller, distances of 1.1 mm from an end surface position, in the longitudinal direction, of the pressing roller, i.e., the positions of the roller end surfaces 22*a*F, 22*a*R, to the belt end detection position X, X by the sensors 45F, 45R can be maintained constant. Therefore, even if the offset correcting control of the pressing belt 21 is carried out, by inclining the pressing steering roller 23, the distance between the belt end detection positions X, X by the sensors 45F and 45R and the positions of the roller end surfaces 22*a*F, 22*a*R of the pressing roller 22 are always maintained at the constant 1.1 mm. In other words, the distance between the belt end detection positions X, X by the sensors 45F, 45R and the positions of the roller end surfaces 22*a*F, 22*a*R of the pressing roller 22 is always maintained at the constant 1.1 mm, irrespective of the inclination of the pressing steering roller 23. By this, in the case where a reciprocation range of the pressing belt 21 for carrying out the offset correcting control of the pressing belt 21 is set, it is not necessary to consider the play of the pressing roller and the error on the manufacturing of the roller length of the pressing roller, and therefore, the large reciprocation range of the pressing belt 21 can be selected. By this, it becomes unnecessary that the roller length of the roller portion of the pressing roller 22 is long, and therefore downsizing of the fixing device 111 is accomplished.

Embodiment 2

Other examples of the fixing device will be described. The fixing device shown in the present Embodiment 2 is the same as the fixing device 111 of Embodiment 1 except for the play-removing-urging regulating structure for the pressing roller 22. In the present Embodiment 2, the like reference numerals as in the foregoing embodiment are assigned to the elements having the corresponding functions. The play-removing-urging regulating structure will be described for the pressing roller 22 of the fixing device 111 according to this Embodiment 2. FIG. 5 is the schematic view, as seen from the sheet discharging side, of the pressing unit of the fixing device according to this Embodiment 2, and, and it is an illustration of the play-removing-urging regulating structure of the pressing roller. Part (a) of FIG. 6 is an illustration showing a displacement state of a pressing arm of the play-removing-urging regulating structure for the one longitudinal end portion side of the pressing roller, and part (b) of FIG. 6 is an illustration showing a displacement state of a pressing arm of the play-removing-urging regulating structure for the other longitudinal end portion side of the pressing roller. There is provided a sensor base 51F adjacent to the outer surface of the one longitudinal end portion side metal core 22*a*F of the pressing roller 22. The sensor base 51F supports the pressing arm (member-to-be-detected) 52F which is an elongated member rotatable about a rotation axis 53F in the substantial center portion of a pressing arm 52F. A coil spring (urging member) 54F is hooked between an engaging portion 52Fa provided in the pressing arm 52F and an engaging portion 51Fa provided in the sensor base 51F. By the coil spring 54F a pressing portion 52Fb provided in the pressing arm 52F is contacted to the roller end surface 22*b*F of the one longitudinal end portion side of the pressing roller 22 to urge the roller end surface 22*b*F to the other longitudinal end portion side of the pressing roller 22. By this, the large diameter portion 22*a*F1 of the metal core 22*a*F of the pressing roller 22 is spaced by the amount of play of 0.6 mm described above from the bearing 22F. The sensor base 51F is provided with a sensor (detection member) 55F for detecting the position of the one longitudinal end portion of the pressing belt 21 through the pressing arm 52F. The sensor 55F is disposed opposed to the pressing arm 52F in the longitudinal direction of the pressing belt 21 and is provided at a position spaced by the predetermined distance a from the pressing arm 52F. Similarly, there is provided a sensor base 51R adjacent to the outer surface of the metal core 22*a*R by the other longitudinal end portion side of the pressing roller 22. The sensor base 51R supports the pressing arm (member-to-be-detected) 52R which is an elongated member rotatable about the rotation axis 53R in the substantial center portion of a pressing arm 52R. A coil spring (urging member) 54R is hooked between an engaging portion 52Ra provided in the pressing arm 52R and an engaging portion 51Ra provided in the sensor base 51R. A pressing portion 52Rb provided in the pressing arm 52R is contacted to the other longitudinal end portion side edge 22*b*R of the pressing roller 22 by the coil spring 54R to urge the roller end surface 22*b*R to the one longitudinal end portion side of the pressing roller 22. By this, a large diameter portion 22*a*R1 of the metal core 22*a*R of the pressing roller 22 is spaced by the amount of play of 0.6 mm described above from the bearing 22R. The sensor base 51R is provided with the sensor for detecting the one longitudinal end portion position of the pressing belt 21 through the pressing arm 52R (detection member) 55R. The sensor 55R opposes to the pressing arm 52R in the longitudinal direction of the pressing belt 21.

In the fixing device according to this Embodiment 2, when the pressing belt 21 offsets to the side plate (41F) side, for example to contact the pressing portion 52Fb of the pressing arm 52F (Part (a) of FIG. 6), the pressing arm 52F is rotated to be displaced in the direction of the arrow about a rotation axis 53F against the urging force of the coil spring 54F. By this, the distance between the pressing arm 52F and the sensor 55F is increased to $\beta$ from $\alpha$. The sensor 55F detects a rotation amount of the pressing arm 52F to output a signal corresponding to the rotation amount to the controller as a detection signal of the end position of the one longitudinal end portion side of the pressing belt 21. The controller inclines the metal core (23*a*F) side of the pressing steering roller 23 in the predetermined direction (the direction of the arrow B2 shown in part (a) of FIG. 3), on the basis of the output signal of the sensor 55F, by which the pressing belt 21 begins to offset and move to the side plate (41R) side. When the pressing belt 21 offsets and contacts the side plate (41R) side to contact to the pressing portion 52Rb of the pressing arm 52R (Part (b) of FIG. 6), the pressing arm 52R is rotated in the direction of the arrow about a rotation axis 53R against the urging force of the coil spring 54R (displacement). By this, the distance between the pressing arm 52R and the sensor 55R is increased to $\beta$ from $\alpha$. The sensor 55R detects the rotation amount of the pressing arm 52R to output the signal corresponding to the rotation amount to the controller as the detection signal of the other longitudinal end portion side end position of the pressing belt 21. The controller inclines the metal core (23*a*R) side of the pressing steering roller 23 in the predetermined direction (the direction of the arrow B1 shown in part (a) of FIG. 3), on the basis of the output signal from the sensor 55R, by which the pressing belt 21 begins to offset and move toward the side plate (41F). Similarly to the fixing device 111 of Embodiment 1, by repeatedly carrying out the above-described process, the belt offset correcting control for correcting the position of the pressing belt 21 in the longitudinal direction is carried out, so that the pressing belt 21 does not protrude from the end surface of the one longitudinal end portion or the other longitudinal end portion of the pressing steering roller 23.

In the fixing device according to this Embodiment 2, the pressing roller 22 is rotated to the state that the roller end surfaces 22*a*F, 22*a*R of the pressing roller 22 contact the pressing portions 52Fb, 52Rb of the pressing arms 52F, 52R. For this reason, during the rotation of the pressing roller 22, it does not move to remove the play to the metal core (22*a*F) or metal core (22*a*R) side. More particularly, the play-removing urging of the pressing roller 22 can be regulated. By this, the distances a between the positions of the pressing arms 52F, 52R contacted to the roller end surfaces and the sensors 55F, 55R can be maintained constant irrespective of the play of the pressing roller or the manufacturing error in the roller length of the pressing roller. Therefore, the distance between the positions of the pressing arms 52F, 52R contacted to the roller end surface and the sensors 55F, 55R is always maintained at the constant amount a even if the offset correcting control of the pressing belt 21 is carried out by inclining the pressing steering roller 23. In other words, the distance between the positions of the pressing arms 52F, 52R contacted to the roller end surface and the sensors 55F, 55R is always maintained at the constant amount a independently of the inclination of the pressing steering roller 23. By this, in the case where the reciprocation range of the pressing belt 21 for carrying out the offset correcting control of the pressing belt 21 is set, it is not necessary that the play of the pressing roller and the error on the manufacturing in the roller length of the pressing roller are taken into account, and therefore, the large reciprocation range of the pressing belt 21 can be selected. By this, it becomes unnecessary that the roller length of the roller portion of the pressing roller 22 is long, and therefore, the downsizing of the fixing device 111 is accomplished.

Other Embodiments

1) In the fixing devices of Embodiment 1 and Embodiment 2, the pressing belt is trained around the pressing roller and the pressing steering roller, but the pressing belt may be trained around the three or more rollers.

2) In place of the fixing roller, a fixing unit may be used, which is provided with a fixing belt (belt member), a plurality of rollers (fixing roller and fixing steering roller, for example) supporting the fixing belt, and the heating source for heating the fixing belt. The present invention can provide the image heating apparatus and the belt feeding device used for the image heating apparatus even if a steering roller is inclined, and the end of the belt member can be detected at the constant position relative to the position of the rotatable member for the positioning, and therefore, the downsizing of an apparatus itself is accomplished.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 175201/2009 filed Jul. 28, 2009 which is hereby incorporated by reference.

What is claimed is:

1. An image heating apparatus comprising:

a belt member;

an inclinable steering roller configured to support said belt member;

a heating member configured to contact said belt member and heat an image on a recording material;

a detecting member configured to detect a position of a belt end in a widthwise direction of said belt member;

a correcting device configured to correct a position of said belt member in the widthwise direction by inclining said steering roller in accordance with a detected position of the belt end by said detecting member; and a supporting device configured to support said detecting member; said supporting device being provided with a contact portion for press-contacting an end surface of one end portion of a pressing roller configured to press said belt member against said heating member, wherein said detecting member is moved in the same direction as a movement direction of said contact portion in interrelation with the movement of said contact portion.

2. An apparatus according to claim 1, wherein said contact portion presses the end surface of the pressing roller by an elastic member.

3. An apparatus according to claim 1, wherein when said contact portion contacts said end surface, a gap between said contact portion and said detection member is constant.

4. An apparatus according to claim 1, wherein said detection member is supported by said contact portion.

5. An apparatus according to claim 1, further comprising:

a second detecting member configured to detect a belt end of a side of said belt member different from said belt end detected by said detecting member with respect to the widthwise direction;

a second supporting device configured to support said second detection member; and a second contact portion, provided in said second supporting device, for press-contacting an end surface of another end portion of the pressing roller.

* * * * *